United States Patent [19]

Hanaoka et al.

[11] Patent Number: 4,822,186

[45] Date of Patent: Apr. 18, 1989

[54] CARRIAGE MECHANISM FOR THERMAL PRINTER

[75] Inventors: Seiji Hanaoka; Masahiro Minowa, both of Suwa; Masataka Okamura, Kounosu; Masao Masumura, Kumagaya; Tooru Iwasa; Noboru Watanabe, Kumagaya; Shoichi Mitsugi, Kumagaya; Norimichi Miyazawa, Nagano, all of Japan

[73] Assignees: Seiko Epson Corporation, Tokyo; Jeco Company Limited, Gyoda, both of Japan

[21] Appl. No.: 203,545

[22] Filed: May 26, 1988

Related U.S. Application Data

[63] Continuation of Ser. No. 914,807, Oct. 3, 1986, abandoned.

[30] Foreign Application Priority Data

Oct. 21, 1985 [JP] Japan ..... 60-234981

[51] Int. Cl.[4] ..... B41J 3/20

[52] U.S. Cl. ..... 400/120; 400/185

[58] Field of Search ..... 400/120, 185, 320, 356; 346/76 PH

[56] References Cited

U.S. PATENT DOCUMENTS

| | | | |
|---|---|---|---|
| 3,948,382 | 4/1976 | Nesbitt et al. | 400/221.2 |
| 4,443,124 | 4/1984 | Ozawa | 400/225 |
| 4,517,573 | 5/1985 | Yara | 400/120 |
| 4,609,299 | 9/1986 | Hattori et al. | 400/120 |
| 4,651,165 | 3/1987 | Shimada | 400/120 |

FOREIGN PATENT DOCUMENTS

| | | | |
|---|---|---|---|
| 184685 | 10/1984 | Japan | 400/120 |
| 85981 | 5/1985 | Japan | 400/120 |
| 92884 | 5/1985 | Japan | 400/120 |
| 154090 | 8/1985 | Japan | 400/120 |
| 151086 | 8/1985 | Japan | 400/120 |

OTHER PUBLICATIONS

S. L. Applegate et al; "Motor Drive Arrangement for Ribbon Feed and Printhead Positioning Control"; *IBM Tech. Disc. Bull.;* vol. 25, No. 11B, pp. 6236–8; Apr. 1983.

*Primary Examiner*—David A. Wiecking

*Attorney, Agent, or Firm*—Ladas & Parry

[57] ABSTRACT

A carriage mechanism for a printer comprises an ink ribbon take-up mechanism for taking up an ink ribbon, a head moving mechanism for moving a printing head which is provided on a carriage between a printing position where the printing head can carry out a printing operation by transferring ink coated on the ink ribbon on a recording paper and a non-printing position where the printing head does not carry out the printing operation, and a single driving source for selectively driving the ink ribbon take-up mechanism and the head moving mechanism.

3 Claims, 6 Drawing Sheets

CARRIAGE MECHANISM FOR THERMAL PRINTER

This is a continuation of co-pending application Ser. No. 914,807, filed on Oct. 3, 1986, now abandoned.

BACKGROUND OF THE INVENTION

The present invention generally relates to carriage mechanisms for printers, and more particularly to a carriage mechanism for a printer in which a printing operation and an operation of taking up an ink ribbon are carried out when a printing head is in a printing position and the printing operation is interrupted when the printing head is in a non-printing position.

Conventionally, there is a thermal printer which carries out a printing operation by melting ink coated on an ink ribbon by heating elements of a thermal printing head (hereinafter simply referred to as a head) and transferring the melted ink on a recording paper. In such a thermal printer, the printing operation is carried out when the head is in a printing position where the head is in contact with the ink ribbon and can transfer the ink of the ink ribbon on the recording paper. A carriage which is provided with the head is successively moved in a printing direction and the ink ribbon is taken up by a predetermined quantity every time a predetermined quantity of printing is completed. For example, when returning the carriage to a set position where the next printing operation is to be started, the head is first moved to a non-printing position where the head is separated from the ink ribbon before moving the carriage.

In the conventional thermal printer, the ink ribbon is taken up by use of a motor provided exclusively for taking up the ink ribbon, and the head is moved between the printing and non-printing positions by use of a solenoid plunger and the like. In other words, the taking up of the ink ribbon and the moving of the head are performed by use of independent driving devices. As a result, there are problems in that the construction of the printer is complex, the construction of a driving and controlling system is complex because of the need to independently control the driving devices for the ink ribbon and the head, and the printer as a whole is expensive.

In addition, in the conventional thermal printer, it is difficult to adjust a contact force of the head on the ink ribbon and the recording paper when carrying out the printing operation by moving the head to the printing position. For this reason, there are problems in that an unwanted printing operation may be carried out erroneously and a large contact noise may be generated. Furthermore, when moving the head to the non-printing position and then moving the carriage, there is a problem in that the ink ribbon may rub the recording paper as the carriage is moved when the head is not completely separated from the ink ribbon due to breakdown of the solenoid plunger and the like.

SUMMARY OF THE INVENTION

Accordingly, it is a general object of the present invention to provide a novel and useful carriage mechanism for a printer in which the problems described heretofore are eliminated.

Another and more specific object of the present invention is to provide a carriage mechanism for a printer in which an ink ribbon take-up mechanism and a head moving mechanism are selectively driven by a single driving means. According to the carriage mechanism of the present invention, the construction of the printer is simple and the printer as a whole is inexpensive because the ink ribbon take-up mechanism and the head moving mechanism are driven by the single driving means. In addition, since it is sufficient to control the single driving means, the construction of a driving and controlling system is simple. Furthermore, it is possible to prevent an unwanted printing operation from being carried out erroneously and to reduce contact noise because a contact force of a head on an ink ribbon and a recording paper can be set arbitrarily.

Still another object of the present invention is to provide a carriage mechanism for a printer in which a motor which is rotatable in forward and reverse directions is used as the driving means. According to the carriage mechanism of the present invention, the construction of the driving and controlling system is simple because the ink ribbon take-up mechanism and the head moving mechanism are selectively driven depending on a rotating direction of the motor.

A further object of the present invention is to provide a carriage mechanism for a printer which is further provided with detecting means for detecting a position of the head. According to the carriage mechanism of the present invention, it is possible to confirm that the head is positively in the non-printing position where the head is separated from the ink ribbon when moving a carriage to an initial printing position, for example, because the position of the head can be detected by the detecting means. Accordingly, it is possible to prevent the ink ribbon from rubbing the recording paper when the carriage is moved to the initial printing position.

Other objects and further features of the present invention will be apparent from the following detailed description when read in conjunction with the accompanying drawings.

DETAILED DESCRIPTION

Figure 1:
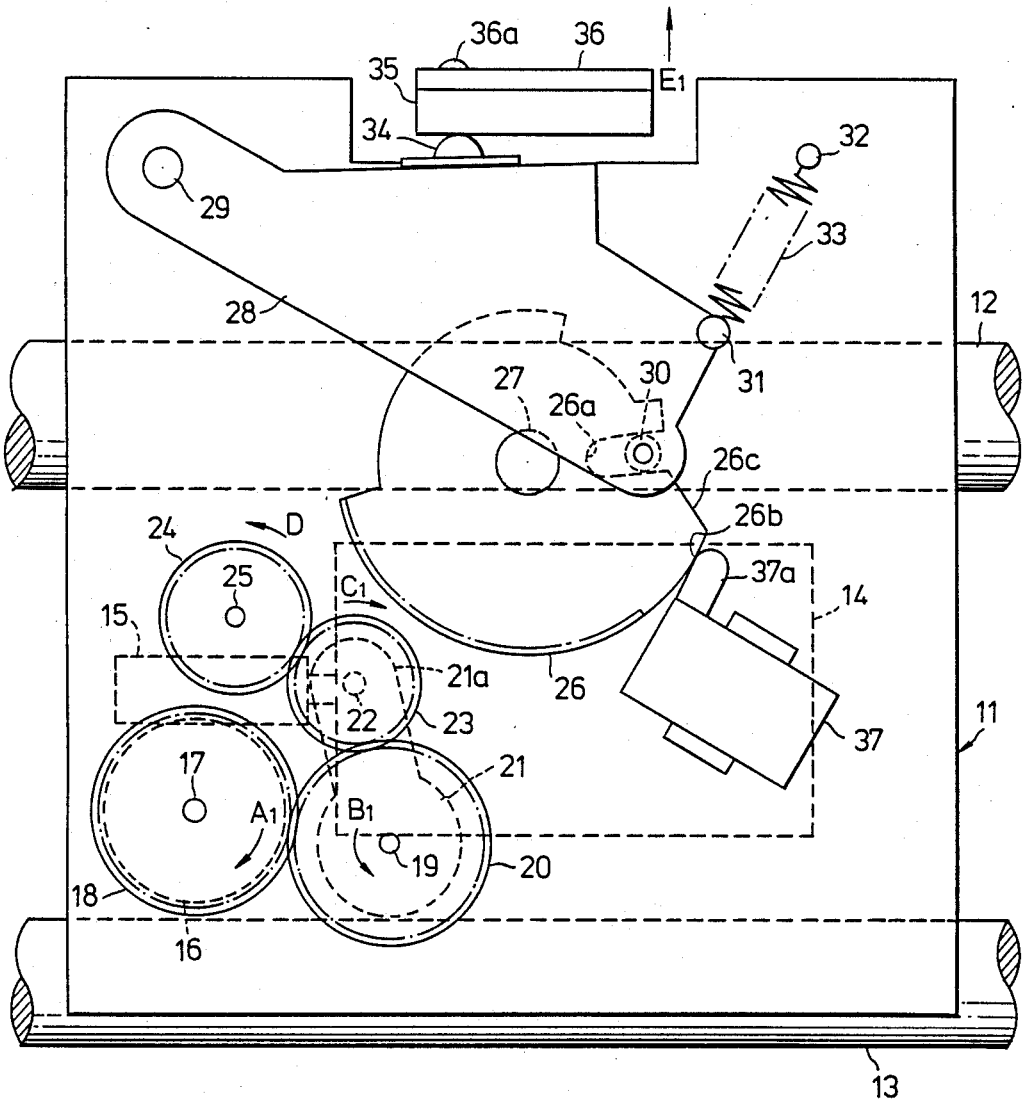
FIGS. 1 and 2 are plan views showing a first embodiment of the carrier mechanism for a printer according to the present invention in a state where a head is in a printing position and in a state where the head is in a non-printing position, respectively.
Figure 2:
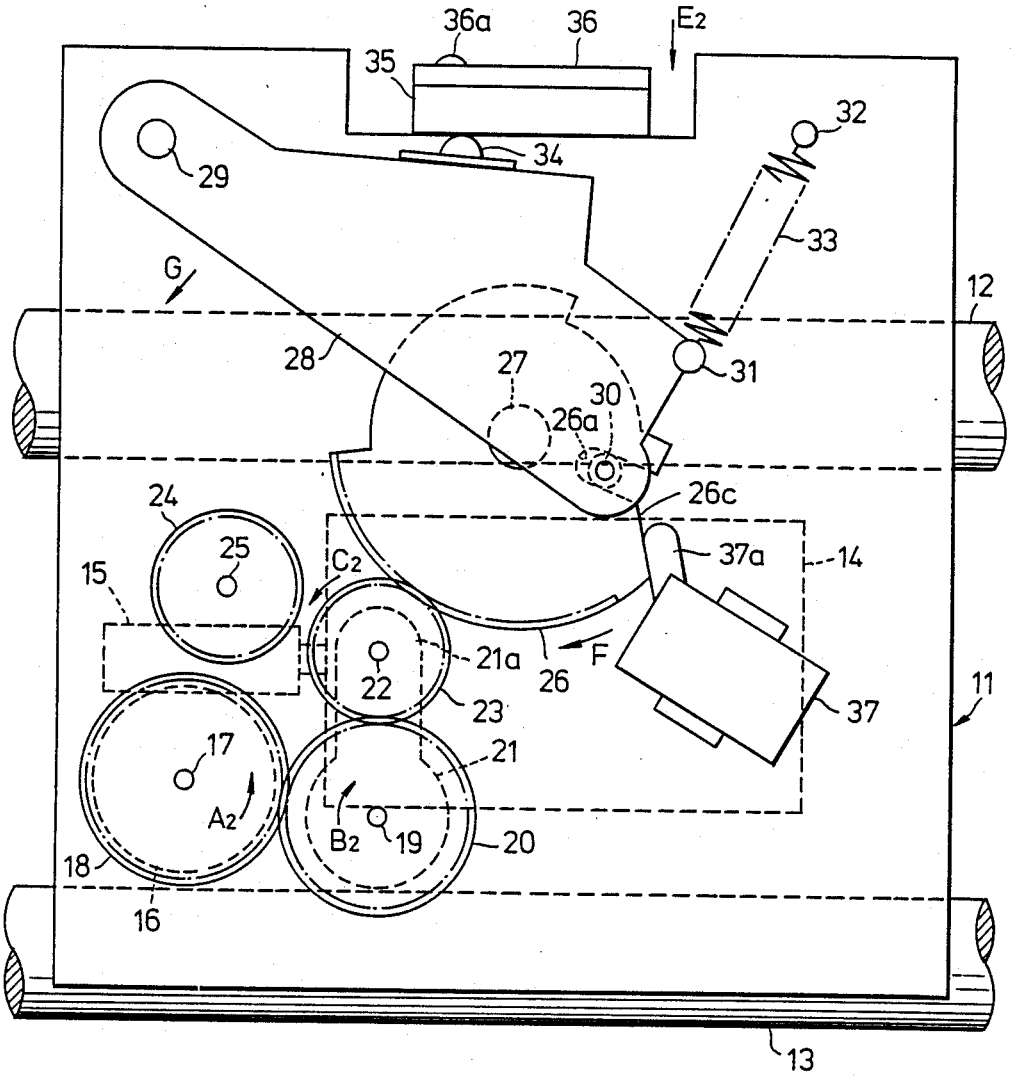
Figure 3:
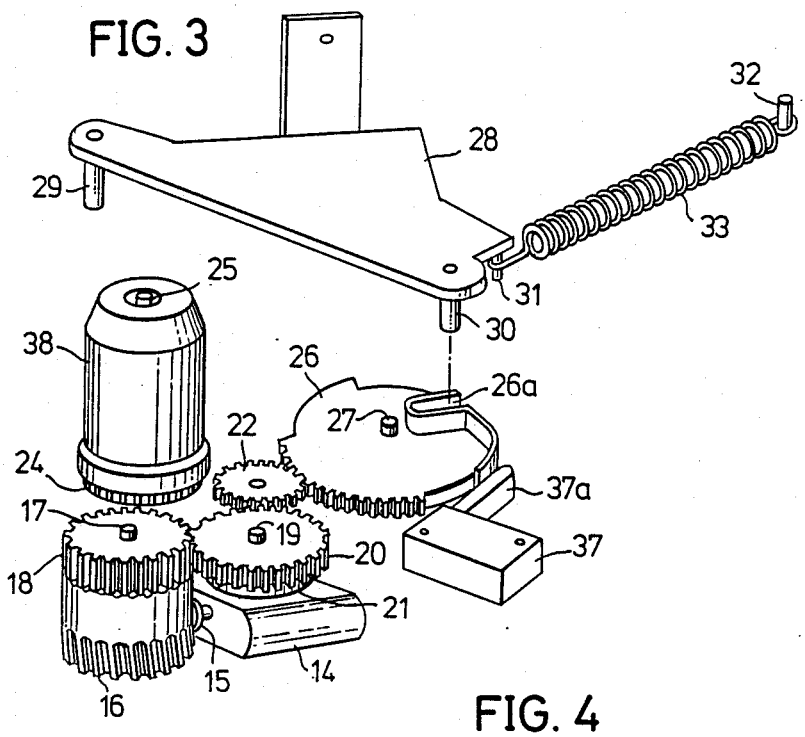
FIG. 3 is a perspective view showing an essential part of the carriage mechanism shown in FIGS. 1 and 2 with a part shown in a disassembled state.
Figure 4:
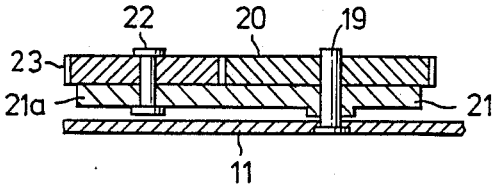
FIG. 4 is a cross sectional view showing an essential part of a rotation transmitting mechanisms of the carriage mechanism shown in FIGS. 1 and 2.

First, description will be given with respect to a first embodiment of the carriage mechanism for a printer according to the present invention, by referring to FIGS. 1 through 5. In FIGS. 1 and 2, a carriage frame 11 is guided by guide rails 12 and 13 and is movable in right and left directions. A motor 14 is fixed to a lower surface of the carriage frame 11. A worm 15 is fixed to a rotary shaft of the motor 14, and the worm 15 is in mesh with a worm wheel 16. As shown in FIG. 3, the worm wheel 16 and a gear 18 are formed integrally. The worm wheel 16 and the gear 18 are rotatably supported by a rotary shaft 17 and penetrate the carriage frame 11 so that the worm wheel 16 projects below the lower surface of the carriage frame 11 and the gear 18 projects above an upper surface of the carriage frame 11. The gear 18 is in mesh with a sun gear 20 rotatably supported on a shaft 19 which is provided on the carriage frame 11. As shown in FIG. 4, a rotary member 21 is pivotally supported on the shaft 19 between the sun gear 20 and the carriage frame 11. The sun gear 20 is placed on the rotary member 21 and the two are in contact with each other. A shaft 22 is fixed to an arm 21*a* a of the rotary member 21, and a planet gear 23 is rotatably supported on the shaft 22 so as to mesh with the sun gear 20. The sun gear 20, the rotary member 21, the shaft 22 and the planet gear 23 constitute a rotation transmitting mechanism.

A gear 24 for driving an ink ribbon (not shown) is arranged at such a position that the planet gear 23 meshes with the gear 24 when the rotary member 21 rotates counterclockwise about the shaft 19 in FIG. 3. The gear 24 is rotatably supported on a rotary shaft 25 which is fixed on the carriage frame 11.

A sector gear 26 is arranged at such a position that the planet gear 23 meshes with the sector gear 26 when the rotary member 21 rotates clockwise about the shaft 19 in FIG. 3. The sector gear 26 is rotatably supported on a rotary shaft 27 which is fixed on the carriage frame 11. A cutout 26*a* is formed on the sector gear 26. A head moving lever 28 is arranged above the sector gear 26. The lever 28 is rotatably supported on a shaft 29 which is provided on the carriage frame 11. A pin 30 provided on the lever 28 on an end opposite from the shaft 29 engages the cutout 26*a* of the sector gear 26. In FIG. 3, the lever 28 is shown in a state disassembled from the rotation transmitting mechanism and the like. A coil spring 33 is stretched across a pin 31 embeddedly provided on the lever 28 in a vicinity of the pin 30 and a pin 32 provided on the carriage frame 11. The coil spring 33 urges the lever 28 to rotate counterclockwise about the shaft 29.

Figure 5:
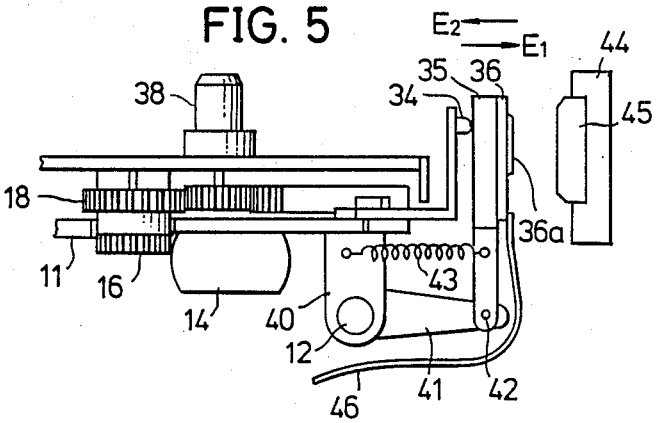
FIG. 5 is a side view showing an essential part of the carriage mechanism shown in FIGS. 1 and 2.

A part of the lever 28 is bent upwardly in FIGS. 3 and 5, and a projection 34 is provided on the bent part of the lever 28. This projection 34 is in contact with a head base 35 on which a thermal head 36 is mounted. As shown in FIG. 5, the guide rail 12 penetrates a support member 40 which is provided on the lower surface of the carriage frame 11, and the head base 35 is rotatably supported on a shaft 42 which is provided on an arm 41 fixed to the support member 40. The head base 35 is constantaly urged to make contact with the projection 34 by the action of a coil spring 43 stretched across the support member 40 and the head base 35. A heating and driving signal is supplied to a heating element 36*a* of the head 36 via a flexible cable 46. A platen 45 is fixed to a platen base 44 and is arranged to confront the head 36. An arm 37*a* of a microswitch 37 mounted on the carriage frmae 11 is in contact with the sector gear 26.

FIG. 4 shows the cross section of the sun gear 20, the planet gear 23 and the like. The rotary member 21 and the sun gear 20 are friction coupled, and a coned disc spring, oil or the like is inserted between the rotary member 21 and the sun gear 20 to ensure positive operation of the rotary member 21.

When carrying out a printing operation, the motor 14 is rotated in a forward direction. Accordingly, the worm wheel 16 and the gear 18 are rotated clockwise (in the direction of an arrow A1), and the sun gear 20 is rotated counterclockwise (in the direction of an arrow B1). Since the sun gear 20 and the rotary member 21 are in contact with each other, the rotary member 21 rotates counterclockwise (in the direction of the arrow B1) together with the sun gear 20. As a result, the planet gear 23 makes contact with and meshes with the gear 24 as shown in FIG. 1. Because the planet gear 23 is in mesh with the sun gear 20 and is rotated clockwise (in the direction of an arrow C1), the gear 24 is rotated counterclockwise (in the direction of an arrows D). The gear 24 rotates an ink ribbon take-up shaft 38 via a slip mechanism (not shown) so as to take up the ink ribbon (not shown). In this state, the planet gear 23 is separated from the sector gear 26. For this reason, the lever 28 is pulled by the coil spring 33, and the head base 35 is pushed in the direction of an arrow E1 by the projection 34 so that the head 36 is in a printing position.

As shown in FIG. 1, the heating element 36*a* is provided on the left portion of the head 36 and the projection 34 pushes the head base 35 at a position just at the rear of the heating element 36*a*. Hence, the head 36 carries out the thermal transfer printing operation by pushing the ink ribbon and the recording paper against the platen 45. A uniform printing can be carried out by the head 36 because the heating element 36*a* is pushed by a force which acts uniformly just at the rear of the heating element 36*a*.

As described before, the slip mechanism (not shown) is provided between the gear 24 and the ink ribbon take-up shaft 38 so that the ink ribbon does not move when the head 36 pushes against the ink ribbon to carry out the printing operation and so that the used ink ribbon can be taken up without slack after the printing. The speed with which the ink ribbon is taken up (that is, the rotational speed of the motor 14) is set large compared to printing speed (that is, the speed with which ink ribbon is drawn out). In addition, the arm 37*a* of the microswitch 37 is in contact with an arcuate portion 26*b* of the sector gear 26 in this state, and the microswitch 26 is turned OFF (or ON).

Next, when the printing of one line is completed and the carriage frame 11 is to be returned to a predetermined printing position by a carriage driving means (not shown), the motor 14 is rotated in a reverse direction. In this case, as shown in FIG. 2, the worm wheel 16 and the gear 18 are rotated counterclockwise (in the direction of an arrow A2) and the sun gear 20 is rotated clockwise (in the direction of an arrow B2). Thus, the rotary member 21 rotates in the direction of the arrow B2 together with the sun gear 20, and the planet gear 23 separates from the gear 24 and makes contact with and meshes with the sector gear 26. Thereafter, the sector gear 26 is rotated clockwise (in the direction of ar arrow F) by the planet gear 23 which rotates counterclockwise (in the direction of an arrow C2). For this reason, the lever 28 is rotated clockwise (in the direction of an arrow G) to a position shown in FIG. 2 by the action of the pin 30 which engages the cutout 26*a* of the sector gear 26. Accordingly, the head base 35 moves in the direction of an arrow E2 and the head 36 separates from the ink ribbon and assumes a non-printing position where the heating element 36*a* is separated from the ink ribbon. In this state, the planet gear 23 is separated from the gear 24 and the ink ribbon is not taken up. Furthermore, the arm 37*a* of the microswitch 37 is in contact with a side 36*c* of the sector gear 36 as shown in FIG. 2 and is turned ON (or OFF). When the microswitch 37 is ON (or OFF), it is detected that the head 36 is in the non-printing position where the heating element 36*a* is separated from the ink ribbon, and the carriage frame 11 becomes movable to the predetermined printing position. For example, the carriage frame 11 is returned to the predetermined printing position by being moved to the left in FIG. 2.

When the motor 14 stops rotating, the worm wheel 16 stops rotating and becomes locked. As a result, the gear 24 or the sector gear 26 in mesh with the planet gear 23 is maintained at the rotary position where the motor 14 stops.

As described heretofore, the ink ribbon is taken up when the motor 14 rotates in the forward direction and the head 36 is moved to the non-printing position when the motor 14 rotates in the reverse direction, and the construction of the printer is simple. Since it is possible to selectively carry out the operation of taking up the ink ribbon and the operation of moving the head 36 by simply controlling the rotating direction of the motor 14, the construction of a driving and controlling system is simple and the cost of the printer can be reduced compared to those of the conventional printer. In addition, it is possible to arbitrarily set the speed with which the ink ribbon is taken up and the speed with which the head 36 is moved, by setting the rotational speed of the motor 14 to a desired value.

Figure 6:
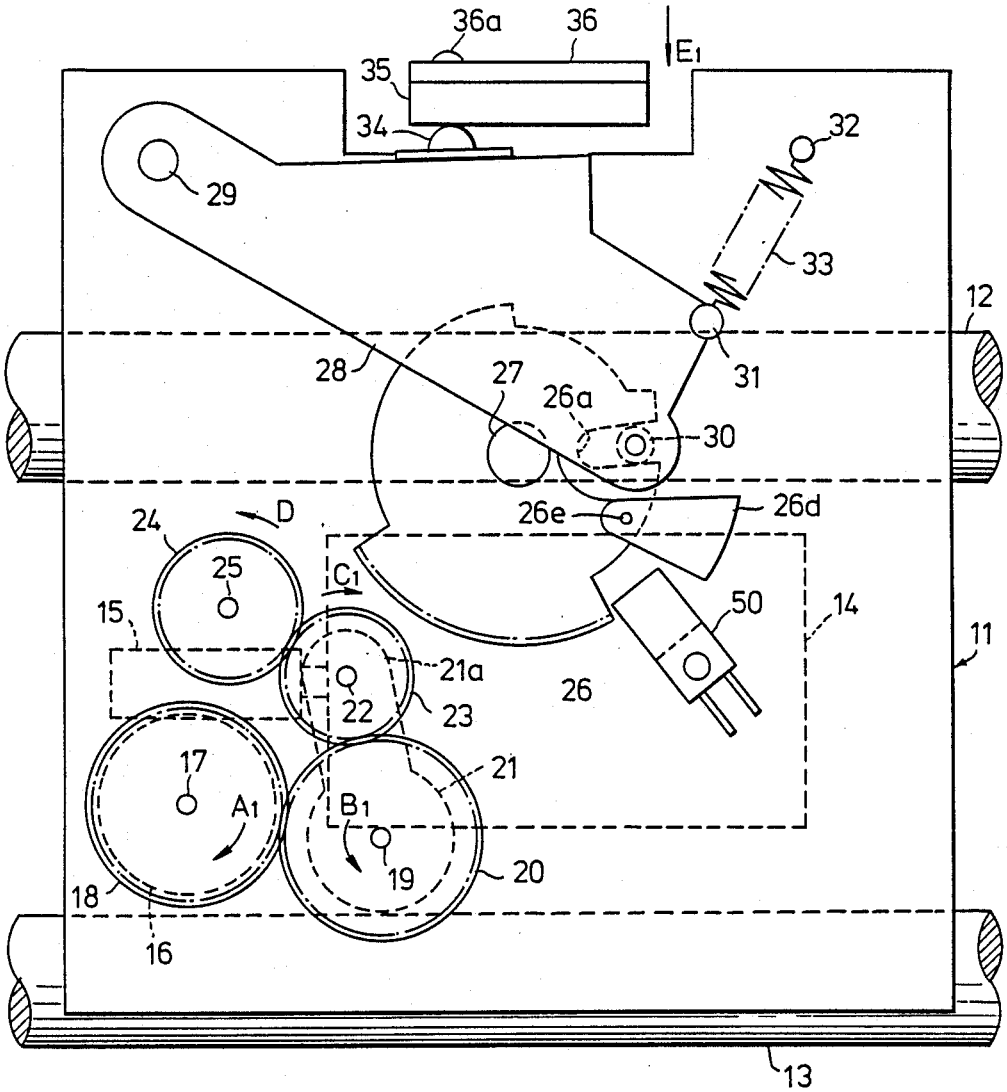
FIGS. 6 and 7 are plan views showing a second embodiment of the carrier mechanism for a printer according to the present invention in a state where the head is in a printing position and in a state where the head is in a non-printing position, respectively.
Figure 7:
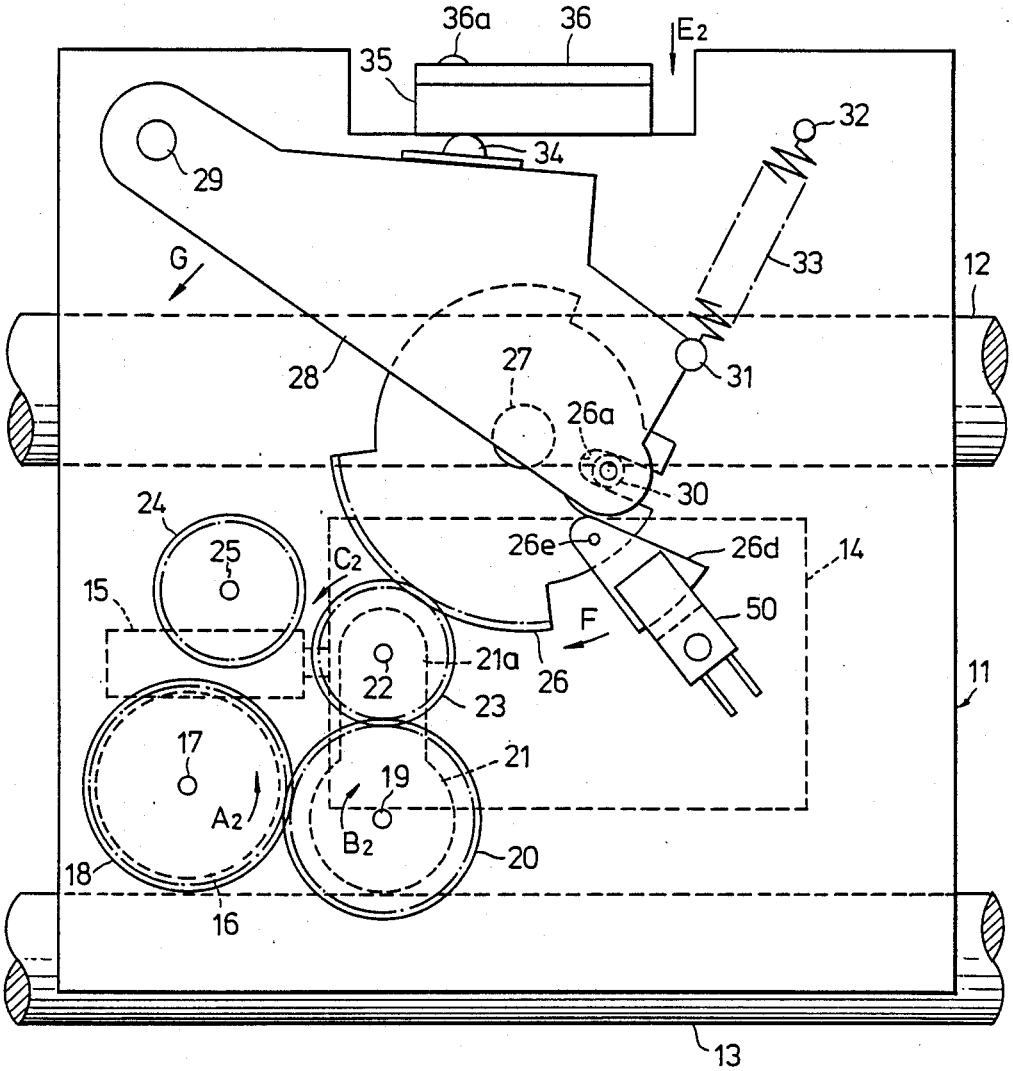
Figure 8:
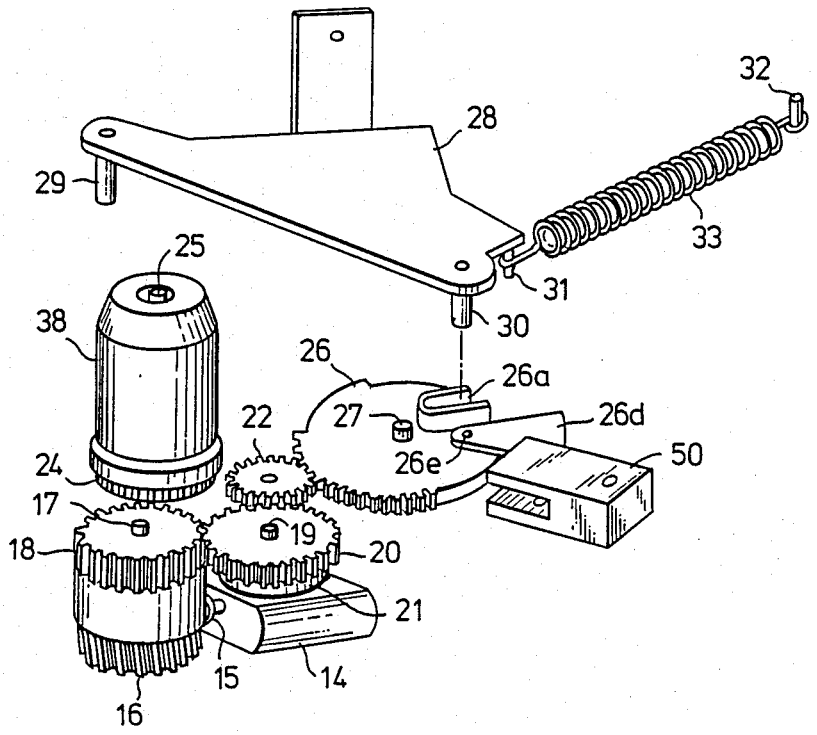
FIG. 8 is a perspective view showing an essential part of the carriage mechanism shown in FIGS. 6 and 7 with a part shown in a disassembled state.

Next, description will be given with respect to a second embodiment of the carriage mechanism of a printer according to the present invention, by referring to FIGS. 6 through 8. In FIGS. 6 through 8, those parts which are the same as those corresponding parts in FIGS. 1 through 3 are designated by the same reference numerals, and description thereof will be omitted. In the present embodiment, a photointerrupter 50 is provided instead of the microswitch 37 and an interrupting plate 26*d* is fixed to the sector gear 26 by a pin 26*e*, as shown in FIGS. 6 through 8. The photointerrupter 50 comprises a light emitting element and a light receiving element.

When the head 36 is in the printing position as shown in FIG. 6, an optical path of the photointerrupter 50 between the light emitting element and a light receiving element is not interrupted by the interrupting plate 26*d* and the photointerrupter 50 is turned ON. On the other hand, when the head 36 is in the non-printing position as shown in FIG. 7, the interrupting plate 26*d* interrupts the optical path of the photointerrupter 50 and the photointerrupter 50 is turned OFF. When the photointerrupter 50 is OFF, it is detected that the head 36 is in the non-printing position separated from the ink ribbon (not shown). Accordingly, it is possible to positively prevent the ink ribbon from rubbing the recording paper (not shown) when the carriage frame 11 is returned to the predetermined printing position, for example.

In each of the embodiments described heretofore, the sun gear 20, the rotary member 21, the shaft 22 and the planet gear 23 constitute the rotation transmitting mechanism, but the construction of the rotation transmitting mechanism is not limited to that of the embodiments.

In addition, in the embodiments, the position of the head 36 is detected by use of the microswitch 37 or the photointerrupter 50, but it is possible to control the motor 14 so that the motor 14 rotates in the forward or reverse direction for only a predetermined time. In this case, it is possible to omit the microswitch 37 and the photointerrupter 50.

Further, the present invention is not limited to these embodiments, but various variations and modifications may be made without departing from the scope of the present invention.

What is claimed is:

1. A carriage mechanism for a thermal printer which comprises a platen and a guide member, said carriage mechanism comprising:

ink ribbon take-up means for taking up an ink ribbon which is coated with ink;

a movable carriage guided by said guide member, for carrying a thermal head and said ink ribbon take-up means;

head moving means mounted on said carriage for holding the thermal head at a printing postion so as to push the thermal head against a recording paper on the platen through the ink ribbon while a printing operation is carried out, and for holding the thermal head stationary at a non-printing position while the printing operation is not being carried out, the thermal head in the non-printing position being spaced from the platen, said head moving means comprising spring means for constantly urging said thermal head toward the printing position; and driving means mounted on said carriage, said driving means comprising a single motor rotatable in both of forward and reverse directions and rotation transmitting means for selectively transmitting a rotation of said motor to one of said ink ribbon take-up means and said head moving means depending on a rotational direction of said motor, said motor constituting a driving source for driving said ink ribbon take-up means to take up a used part of the ink ribbon while the thermal head is in the printing position, said used part of the ink ribbon having been used for the printing operation during a displacement of said carriage, and said motor further constituting a driving source for driving said head moving means to move the thermal head between said printing position and said non-printing position, said rotation transmitting means comprising a rotary member supported on a pivot shaft, a first gear which is rotatably supported coaxially to the pivot shaft on said rotary member and is rotated by said motor, and a second gear which is rotatably supported on a free end of said rotary member and is in mesh with said first gear, said rotary member pivoting to a first position so that said second gear drives said head moving means to move said thermal head toward the non-printing position against a force of said spring means when said motor rotates in one of the forward and reverse directions and pivoting to a second position so that said second gear drives said ink ribbon take-up means when said motor rotates in the other of the forward and reverse directions.

2. A carriage mechanism as claimed in claim 1 which further comprises detecting means for detecting a position of said printing head.

3. A carriage mechanism as claimed in claim 2 in which said detecting means comprises a sensor for detecting whether or not said printing head is in the non-printing position, so that said carriage becomes movable to a predetermined printing position only when said printing head is in said non-printing position.

* * * * *